US006308628B1

(12) United States Patent
Bronstein et al.

(10) Patent No.: US 6,308,628 B1
(45) Date of Patent: Oct. 30, 2001

(54) IMAGING METHOD OF A PRINTING MEMBER HAVING MAGNETIC PARTICLES

(75) Inventors: Refael Bronstein, Kfar Saba; Murray Figov, Ra'anana, both of (IL)

(73) Assignee: Karat Digital Press L.P., Herglia (IL)

( * ) Notice: Subject to any disclaimer, the term of this patent is extended or adjusted under 35 U.S.C. 154(b) by 0 days.

(21) Appl. No.: 09/480,447

(22) Filed: Jan. 10, 2000

(51) Int. Cl.[7] ..... B41C 1/10
(52) U.S. Cl. ..... 101/467; 101/401.1; 101/478
(58) Field of Search ..... 101/453, 454, 101/457, 462, 463.1, 465–467, 478, 395, 401.1; 430/302, 303, 306

(56) References Cited

U.S. PATENT DOCUMENTS 4,003,312 * 1/1977 Gunther ..... 101/466
4,380,196 * 4/1983 Kato et al. ..... 101/453
4,833,486 * 5/1989 Zerillo ..... 101/463.1
5,129,321 * 7/1992 Fadner ..... 101/467
5,339,737 8/1994 Lewis et al. ..... 101/454
5,362,604 * 11/1994 Yatsuyanagi ..... 430/306
5,409,799 * 4/1995 Uytterhoeven et al. ..... 101/467
5,417,164 * 5/1995 Nishida et al. ..... 101/453
5,501,938 * 3/1996 Ellis et al. ..... 430/201
5,551,341 9/1996 Lewis et al. ..... 101/453
5,587,261 * 12/1996 Audett et al. ..... 101/395
5,632,204 5/1997 Lewis ..... 101/453
5,633,123 * 5/1997 Hill et al. ..... 430/945
5,755,158 5/1998 Wolfe et al. ..... 101/425
5,807,658 9/1998 Ellis et al. ..... 430/302
5,882,840 * 3/1999 Daems et al. ..... 430/306
6,174,646 * 1/2001 Hirai et al. ..... 430/302

* cited by examiner

*Primary Examiner*—Stephen R. Funk
(74) *Attorney, Agent, or Firm*—Eitan, Pearl, Latzer & Cohen-Zedek

(57) ABSTRACT

A lithographic printing member comprises a base material and a coating provided thereon. The coating having one or more layers containing magnetic particles. Printing processes and products are also disclosed.

3 Claims, 10 Drawing Sheets

IMAGING METHOD OF A PRINTING MEMBER HAVING MAGNETIC PARTICLES

FIELD OF THE INVENTION

The present invention relates to digital printing apparatus and methods, and more particularly to a method for manufacturing an imaging and printing member, suitable for the computer-to-film, computer-to-plate and on-press imaging, that does not require post-imaging processing.

BACKGROUND OF THE INVENTION

Lithography or offset printing is currently the dominant printing technology. The printing is typically performed by a printing form/plate that has a specially prepared/treated surface, some areas of which are capable of accepting lithographic ink, whereas other areas, when moistened with water or special solution, will repel the ink. For a positive printing plate, the areas that accept ink form the printing image areas and the water accepting (ink-repelling) areas form the background areas. For a negative printing plate, the plate imaging conditions are reversed. The specially prepared/treated plate surface typically comprises an anodized aluminum surface, coated by a thin layer of ink receptive photopolymer that hardens when exposed to an image-wise radiation (the radiation that creates the image on the plate). In a subsequent development stage, the non-exposed areas are washed out, exposing the water accepting anodized aluminum surface, and leaving islands of hardened, ink receptive polymer. This process results in a plate that provides excellent image quality and sustains long mechanical wear and tear, typical for long printing runs.

Use of this type of printing plates implies use of water on the printing press. The complicated relationship between the amounts of water and the amount of ink requires significant skills from the press operator. Another disadvantage of these printing plates is that the development or processing involves the use of chemicals and/or solvents, the disposal of which requires certain care and control. The plates are typically sensitive to UV radiation and the scarcity of digital UV radiation sources complicates their exposure by digital exposure means such as platesetters.

To overcome this latter obstacle, development of so-called thermal offset printing plates was undertaken, for which a large variety of IR radiation sources exist. These plates have recently been commercialiazed by a number of companies. A typical example of a thermal offset printing plate is Kodak Polychrome Direct Image Thermal print plate, commercially available from Kodak Polychrome Graphics, Norwalk, Conn., U.S.A.

Further efforts to reduce or eliminate plate processing have resulted in so called ablation type plates, disclosed in U.S. Pat. Nos. 5,339,737, 5,551,341 and 5,632,204 all to Lewis et al. These patents disclose a lithographic printing plate flat is transformable by laser-discharge techniques, so as to change its affinity for ink. The plate is of the ablation type where a layer or number of layers, the outermost of which is typically made of silicone, are ablated by powerful laser radiation. The outer silicone layer is ink-repelling and the layer underlying the silicone layer is ink-receptive. Laser output typically ablates one or more plate layers, in either case resulting in an image-wise pattern of features on the plate. The plate may include additional layers tat facilitate the ablation process or help in laminating the ablating layer to the aluminum substrate. The plate preparation process may be performed on the press and reduces press make-ready time and potential damage to the plate. Such plate is commercially available from Presstek Inc., Hudson, N.H., U.S.A. and used in a printing press QM-46 DI disclosed in U.S. Pat. No. 5,339, 737 and commercially available from Heidelberg Druckmachinen AG, Heidelberg, Germany.

The ablation process, however, is accompanied by the generation of a large amount of imaging debris and it is necessary to clean the plates to remove this debris before the printing process is commenced. The debris interferes with the laser radiation, by depositing on the focusing lens as an aerosol or mist of fine particles that block the laser radiation transmission. This creates a need for frequent cleaning of the optics and of the exposure compartment.

Digital plates for the conventional "wet" process are imaged by ablating only the top layer (see Presstek "Gold" plate). The ablation products of this process are in the form of air-borne dust and need to be collected by vacuum.

U.S. Pat. No. 5,755,158 to Wolfe et al. discloses another cleaning apparatus for lithographic printing plates, that includes a rotating elastomeric roller that contacts imaged plates, which are typically (although not necessarily) carried on a rotary cylinder, at a velocity different from the velocity (if any) of the plate. The roller may spin in the direction of or opposite to, that of the cylinder and at substantially different speed. Typically, the apparatus is mounted proximate to the cylinder, circumferentially adjacent to the imaging system, and is retractable, so as to be selectively engaged when imaging is complete. The apparatus may include, in addition to, or in lieu of the elastomeric roller, a second retractable cleaning member for rubbing the imaged plate with a cleaning fluid. The second cleaning member may be an elongated cartridge, having an absorbent towel exposed along one face thereof. A cleaning fluid is dispensed onto the towel by, for example, a spraying device. The cartridge is then extended to urge the towel against the printing plate as it rotates. It is clear that such a solution adds cost to the printing equipment, increases its operating complexity and the make-ready time and, accordingly, the cost of printing.

A further effort to simplify the plate cleaning process is disclosed in U.S. Pat. No. 5,807,658 to Ellis et al. The patent discloses a self-cleaning, abrasion-resistant, laser-imageable lithographic printing construction. The construction is a wet lithographic printing plate that includes a protective layer to provide protection against handling and environmental damage, extends plate shelf life, and entrains debris generated by ablation. The protective layer washes away during the printing make-ready process, effectively cleaning the plate and disappearing without the need for a separate removal process. This method, although simplifying the plate usage, does not make the plate ready for printing immediately following the imaging stage. It also adds the cost of the washable layer to the plate and the washing facility to the press. This increases the plate preparation process complexity and the press make-ready time and accordingly the cost of printing. The need for additional, post imaging operations complicates the use of the plate in computer-to-plate devices and on-press digital imaging systems.

Different means have been tried to protect the exposure optics and plate surface from ablation debris. Typically, these are mechanical shutters and baffles that somehow absorb part of the flying debris. Vacuum, or a directed airflow through the gap between the exposure head and the plate, may also assist in the debris evacuation procedure. This, however, may be effective only in cases where all of the protective or oleophobic silicone layer particles are pulled off the plate and are airborne. Should some particles remain attached to the substrate, the vacuum assistance is of no use. Further, both the airflow and the vacuum create vortices that cause debris deposition on other parts of the system.

Exposure of polyester-based plates or films consisting of transparent substrate can be performed through the substrate. This can help in protecting the optics, but does not solve the plate/film-cleaning problem, as the ablation debris continues to be deposited on the film/plate surface and surroundig mechanical parts. This complicates the use of ablation plates and makes them less suitable for on-press imaging.

SUMMARY OF THE INVENTION

The procedure for evacuating debris that was created during a film/plate ablation process may be signifcantly improved if the plate is coated by a mixture of silicone and a well-dispersed material that possesses, for example, magnetic properties. The material exposure is assisted by a directional magnetic field of a desired strength. The magnetic forces in this case attract the ablated particles to a desired place/direction, for example, away from the optical system and the plate surface. Further, since the magnetic particles are surrounded by the silicone or other ablatable material used for the plate manufacturing, the magnetic force adds to the ablation forces and assists complete evacuation of ablation debris from the plate, as well as prevention of their deposition on the exposure optics.

It is an object of the present invention to provide a processless/self-cleaning ablative plate and a method of ablation debris collection, free of the above-described shortcomings of prior art methods.

It is an additional object of the present invention to provide an easy manufacturing method of a processless/self-cleaning printing member, suitable for both computer-to-plate and on-press imaging.

It is a further object of the present invention to provide a processless/self-cleaning ablation film for use as a masking intermediate in conventional platemaking.

It is another object of the present invention to provide an apparatus for the exposure of the processless/self-cleaning ablation plate and film materials.

It is a further object of the present invention to provide an easy-to-manufacture ablation flexographic plate.

It is still another object of the present invention to provide an apparatus for the exposure of the flexographic plate.

Other objects of the invention will become apparent as the description proceeds.

DETAILED DESCRIPTION OF THE INVENTION

Figure 1A:
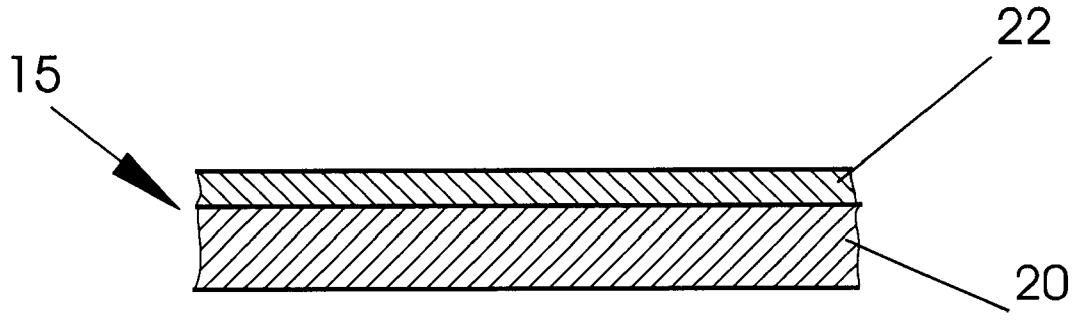
FIG. 1A PRIOR ART
FIGS. 1A and 1B are simplified illustrations of prior art ablatable film and polyester plates.

FIG. 1A is a schematic illustration of a prior art ablatable film, generally denoted by numeral 15, consisting, for the simplicity of explanation, of a film base 20, typically polyester and an ablatable layer 22. The ablatable layer 22 should be dark enough to provide the desired optical density and may include some dyes or pigments that enhance the heat or infrared radiation absorption process and stimulate the ablation processing.

Figure 1B:
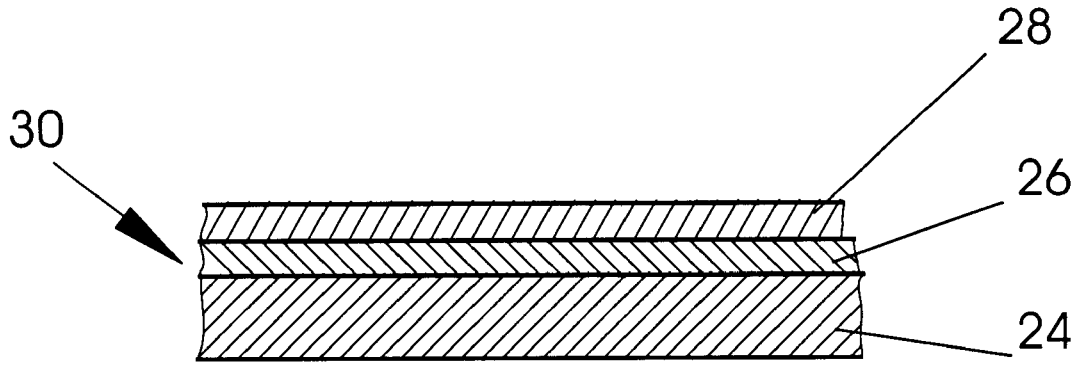
FIG. 1B PRIOR ART

FIG. 1B is a simplified illustration of prior art ablatable plate, generally denoted by numeral 30, consisting, for the simplicity of explanation, of a metal base 24, typically aluminum, a layer 26 capable of absorbing infrared radiation and a surface coating layer 28. The surface coating layer 28 may be oleophobic for waterless printing plates or either hydrophobic or hydrophilic for wet printing plates.

Figure 2:
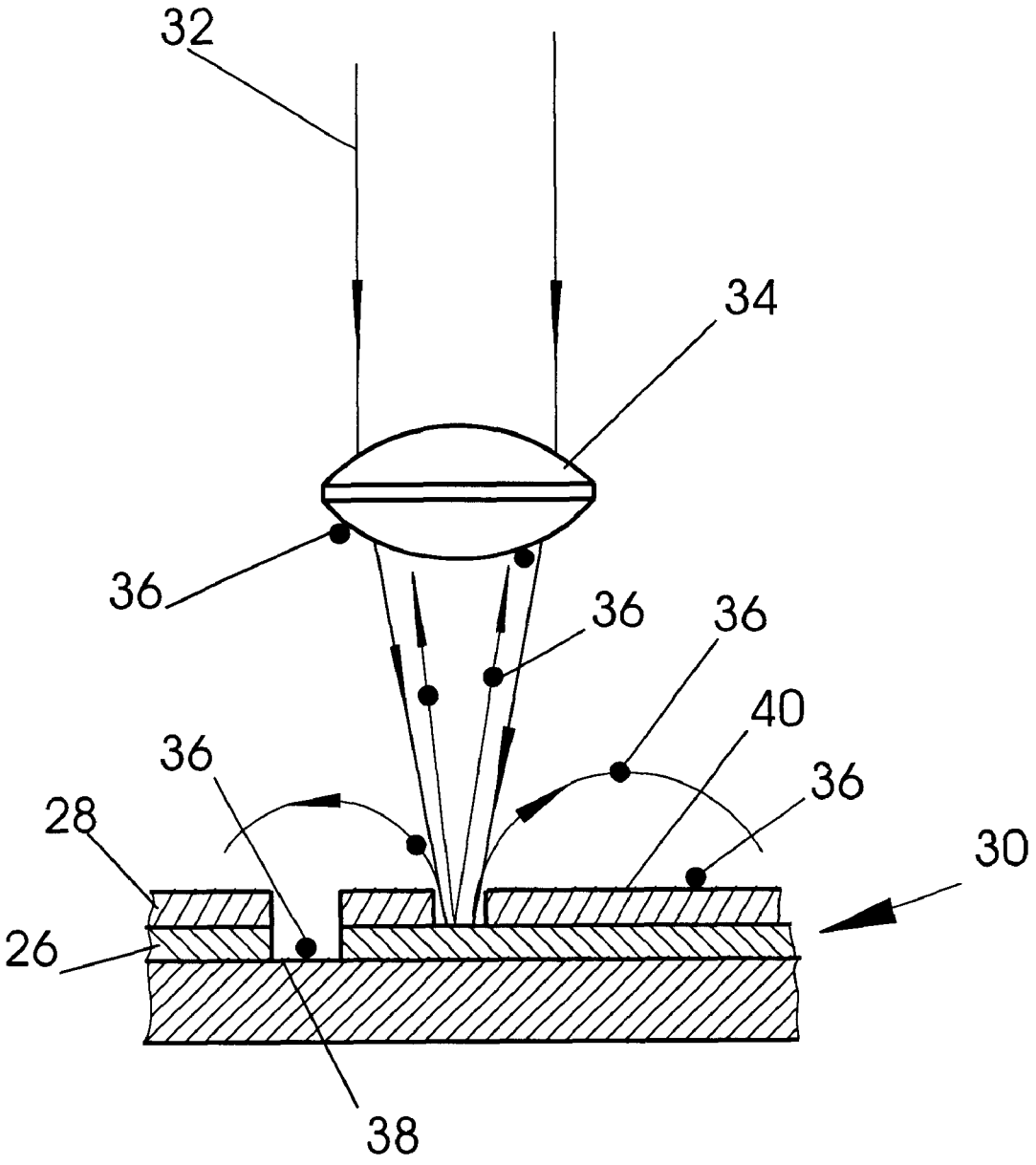
FIG. 2 PRIOR ART
FIG. 2 is a simplified illustration of a prior art imaging method of ablatable film and plate.

FIG. 2 is a simplified illustration of a prior art imaging method of ablatable film or plate. The ablatable plate, generally denoted by numeral 30, is ablated/exposed by a laser beam 32 focused on the plate surface by a lens 34. Numerals 36 indicate the ablation debris, resulting from the ablation of layers 26 and 28. The debris 36, pushed by the micro explosion forces of the ablation process, is deposited on the already ablated areas 38 of the plate, on the not yet ablated areas 40 of the coating 28 and on the lens 34.

Figure 3:
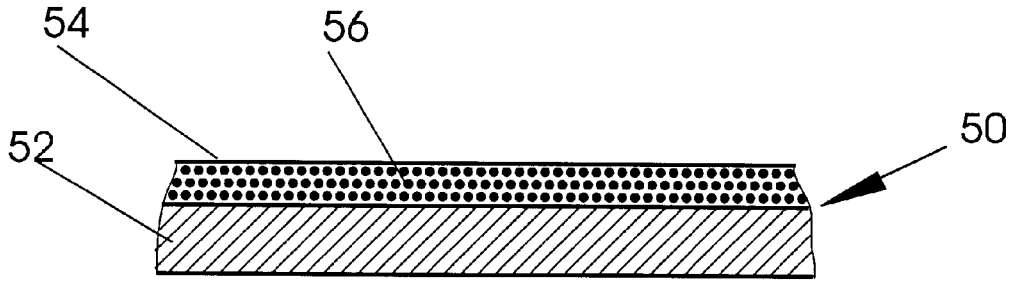
FIG. 3 is a schematic illustration of a basic structure of a processless/self-cleaning ablation film or plate, constructed in accordance with a preferred embodiment of the present invention.

FIG. 3 is a schematic illustration of the basic structure of a processless/self-cleaning ablation film or plate, generally denoted by numeral 50, constructed in accordance with a preferred embodiment of the present invention. The ablation film or plate comprises a base material 52 and a coating 54. The base material 52 may be transparent or opaque. Transparent polyester film, for example, may be used as base material 52 and is readily available from a number of suppliers. One such film is MYLAR film sold by E. I. duPont de Nemours Co., Wilmington, Del., U.S.A. Another is the MEUNEX film sold by ICI Films, Wilmington, Del., U.S.A. A preferred polyester-film thickness for plates is 0.007 inch, but thinner or thicker versions may be used effectively. A preferred polyester-film thickness for films is 0.004 inch, but different thicknesses may also be used. The coating layer 54 is a polymer, dispersed with magnetic particles, for instance magnetite particles 56. The magnetite particles 56 may be such as MO 8029 or MO 4431, commercially available from ISK Magnetics, Inc., Valparaiso, Ind., U.S.A. The magnetic particles 56 tpically have suns of 0.9 to 1.0 micron and are well compatible with the thickness of the coating layer 54. There is no need to place the magnetite particles 56 in an orderly manner within the coating layer 54. The magnetite particles 56 are most advantageously dispersed in silicone and cellulose, of the type described in connection with coating layer 54 and given in the examples below.

EXAMPLE 1

Ablatable Plate—First Coat of a Waterless Plate

The following coating formulation was prepared as a mixture (all numbers designating parts in formulations are given in units indicating their relative part of the overall weight of the formulation).

| | |
|---|---|
| Cellulose Nitrate | 20 parts |
| Methyl Ethyl Ketone | 120 parts |
| Z Mag 1101 (magnetic iron oxide) | 35 parts |

The mixture was milled for 12 hours, to ensure a fine dispersion of the iron oxide pigment and then the following ingredients were stirred in:

| | |
|---|---|
| Cymel 1170 | 7 parts |
| Cycat 4040 | 0.7 parts |

Both materials are commercially available from Dyno-Cytec K.S., Litlestrom, Norway.

The mixture was then bar-coated onto 175 micron thick MELINEX 339 base polyester sheet and dried for 3 minutes at 140° C. to a dry coating weight of 4 grams per square meter.

Next, the following mixture was prepared:

| Ablatable Plate - Second Coat of a Waterless Plate | |
|---|---|
| Alcosil #2 Catalyst A | 50 parts |
| Alcosil #2 Catalyst B | 25 parts |
| Alcosil #2 Silicone Gum | 25 parts |

All of the above materials are commercially available from J. Alcock and Sons Ltd. Manehester, England.

The mixture was then bar-coated onto the previous layer and dried for 3 minutes at 140° C. to a dry coating weight of 2 grams per square meter.

EXAMPLE 2

Ablatable Film

The formulation used for the first coat of Example 1 was coated onto 100-micron polyester base and dried for 4 minutes at 140° C. to a dry thickness of 6 microns.

Figure 4:
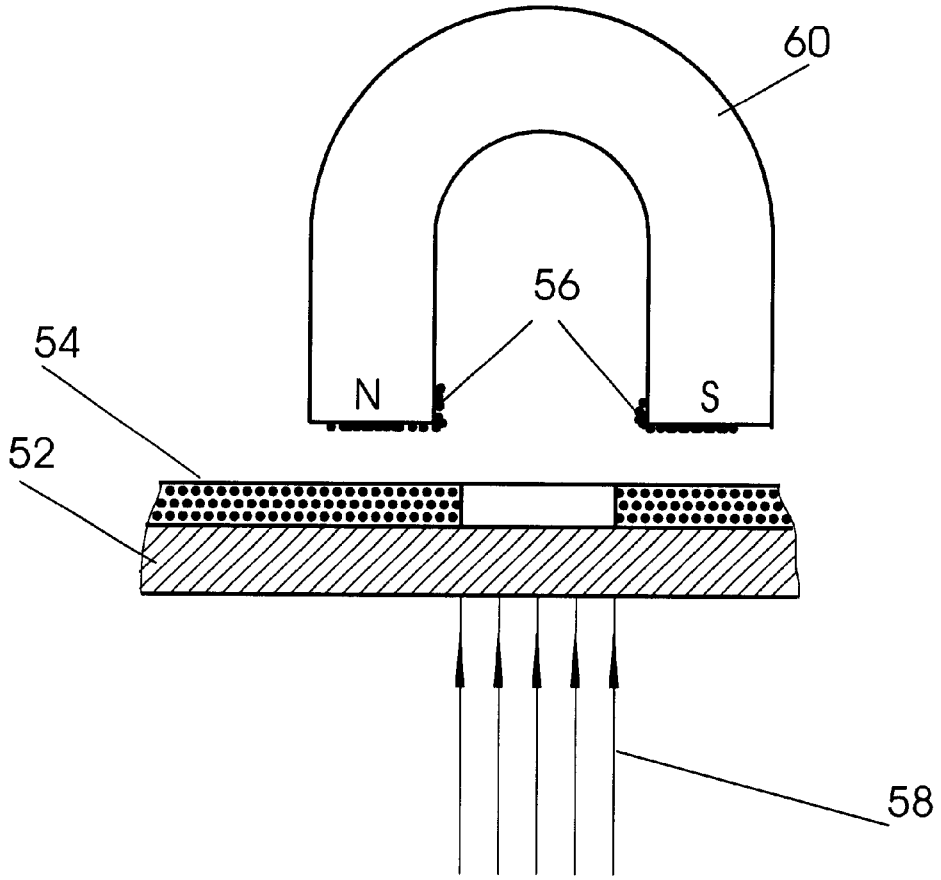
FIG. 4 is a schematic illustration of the ablation apparatus and an ablation method, with automatic debris collection of the processless/self cleaning ablation film or plate of FIG. 3, constructed in accordance with a preferred embodiment of the present invention.

FIG. 4 is a simplified illustration of the ablation apparatus method, with automatic debris collection of the self-cleaning ablation film of FIG. 3. The exposure/ablation of the film in the case of a transparent substrate is performed by a laser 58, which in this particular case exposes through the transparent base layer 52. The removal of material from the coating layer 54 and the capture of magnetic particles 56 is aided by an electro-magnet or a permanent magnet 60, that attracts the magnetic particles 56 together with the coating material of the film base 52 that surrounds them. The gap between the coating layer 54 and the permanent magnet (or an electromagnet) 60, should be selected so as to create the pulling forces required to attract the debris to the magnet Such selection is well within the scope of the skilled person, and is therefore not discussed herein in detail, for the sake of brevity. Cleaning the permanent magnet 60 from the attracted magnetic particles 56 and debris may be performed at a later stage, by any known cleaning method.

Figure 5:
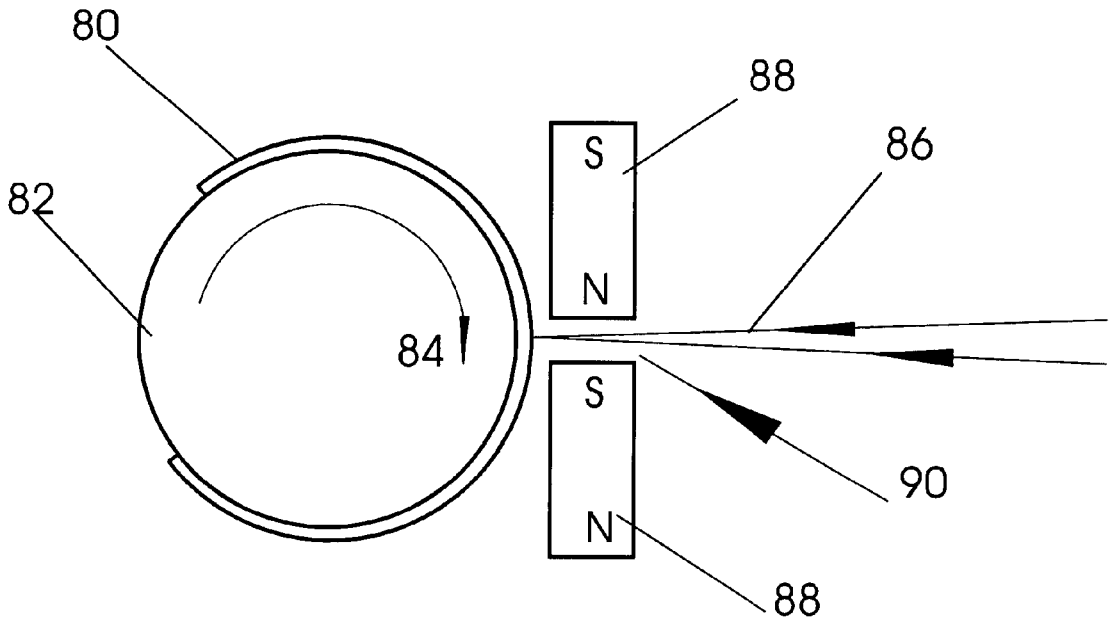
FIG. 5 is another schematic illustration of an ablation apparatus and an ablation method, with automatic debris collection, of the processless/self cleaning ablation plate constructed in accordance with another preferred embodiment of the present invention.

FIG. 5 is a schematic illustration of an ablation apparatus operating according to a preferred embodiment of the invention, using the processless/self-cleaning ablation plate of FIG. 3. A plate 80, in this case, is opaque and is typically a metal substrate such as an aluminum plate used in offset printing. The plate 80 is mounted on a rotating drum 82 that rotates in the direction indicated by arrow 84. The coating on the plate is ablated by a scanning laser beam 86. A pair of permanent rectangular block sintered ferrite magnets 88 of Feroba type, commercially available from Eclipse Magnetics Ltd., Sheffield S9 1EW, England is placed in front of the ablatable surface of the plate 80. The magnets 88 are arranged so that the gap 90 between them is between 2 mm to 3 mm wide and their distance from the drum is between 1 mm to 2 mm. The pair of magnets 88 captures the ablation debris. This arrangement protects the optics from becoming dirty. There is also no debris left on the plate surface. Cleaning of the permanent magnets 88 from the the magnetic particles may be performed later, by any known clean method. The need for this cleaning of the permanent magnets 88, after the plate ablation has been completed, may be eliminated by employing the embodiments sown on FIGS. 6A through 6D and explained hereinbelow.

Figure 6A:
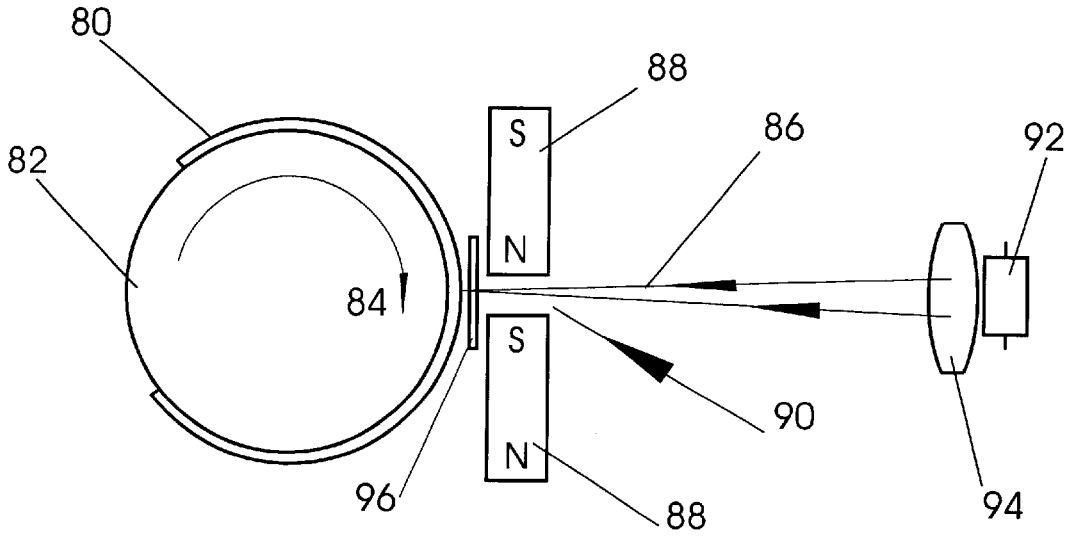
FIGS. 6A, 6B, 6C and 6D are additional schematic illustrations of a number of preferred embodiments of ablation apparatuses and methods, with automatic debris collection of the processless/self cleaning ablation plate constructed in accordance with the present invention.
Figure 6B:
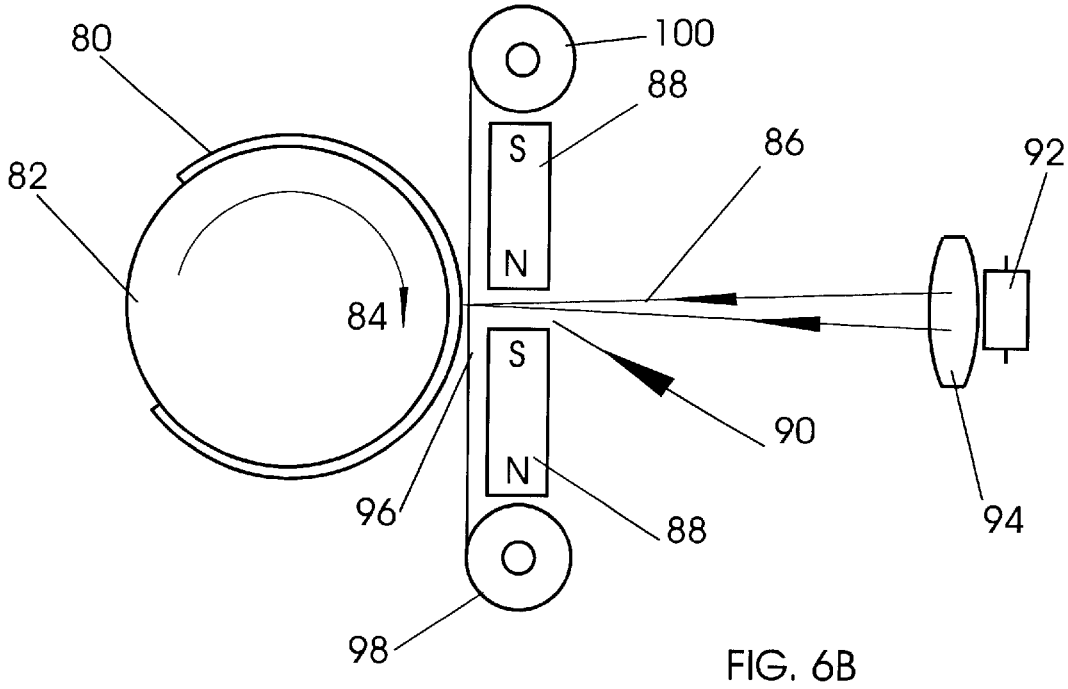

FIGS. 6A and 6B are schematic illustrations of another preferred embodiment of the ablation apparatus and an ablation method with automatic debris collection of the processless/self cleaning ablation plate, constructed in accordance with the present invention.

FIG. 6A is a side view of a flat field type apparatus for ablation of the process/self-cleaning printing member. The printing member/plate 80 is mounted on a rotating drum 82 that rotates in the direction indicated by arrow 84. The coating on the plate is ablated by a scanning laser beam 86. An oscillating mirror 92, or a rotating polygon, provides the laser beam scanning action. The scanning beam is focused by a flat field lens 94. A thin transparent MYLAR film 96, with thickness of 25 to 50 microns, is placed between the plate and the pair of permanent rectangular block sintered ferrite magnets 88. The ablation debris attracted by the magnetic field forces precipitates on the MYLAR film 96. This arrangement protects the optics from becoming dirty. The MYLAR film 96 may be easily removed and replaced when it becomes soiled/dirty.

FIG. 6B is a side view of an apparatus for ablation of the processless/self-cleaning printing member. It shows another arrangement of the apparatus of FIG. 6A, where the MYLAR film is continuously scrolled, from a supply cassette 98 to a receiving cassette 100. This arrangement provides a continuously clean protective film that does not obstruct the ablating beam 86. The film 96 is replaced after a number of plate exposures, by replacing the film cartridge, including both cassettes 98 and 100 and the film.

Figure 6C:
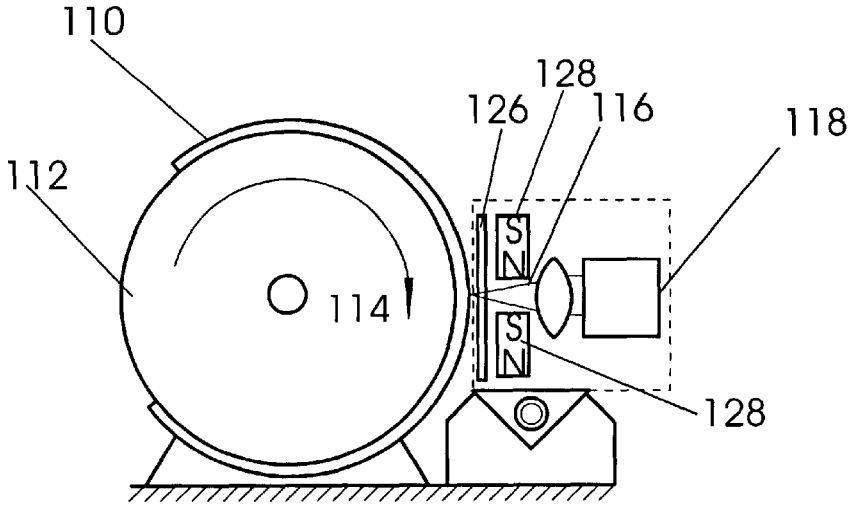
Figure 6D:
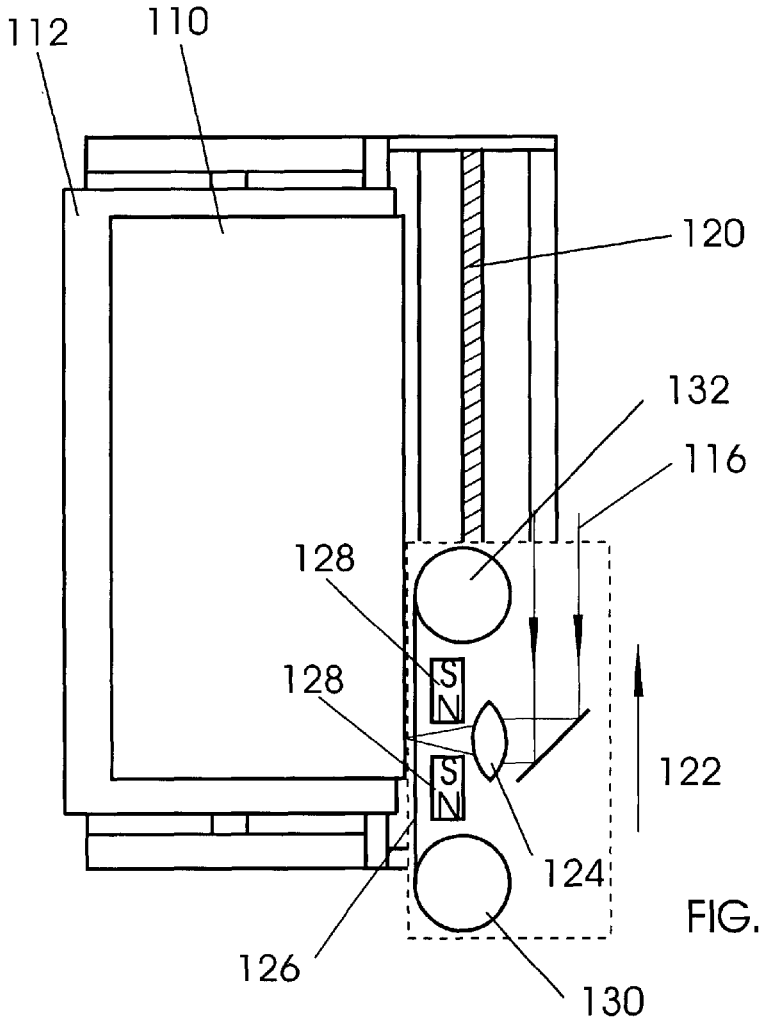

FIGS. 6C and 6D are, respectively, schematic illustrations of the side and top views of an additional preferred embodiment of the ablation apparatus and ablation method with automatic debris collection of the processless/self cleaning ablation plate, constructed in accordance with present invention, FIG. 6C is a side view of an external drum, single beam or multibeam type apparatus, for ablation of the processless/self-cleaning printing member. The printing member/plate 110 is mounted on a rotating drum 112 that rotates in the direction indicated by arrow 114. A scanning laser beam 116 ablates the coating on the plate. The beam is provided by a laser (not shown) or a laser diode (not shown) external to the exposure head 118 and mounted on the head.

FIG. 6D is a top view of the apparatus for ablation of the processless/self-cleaning printing member. It shows an arrangement of the apparatus of FIG. 6C, where the MYLAR film is continuously scrolled from a supply cassette 130 to a receiving cassette 132. This arrangement provides a continuously clean protective film that does not obstruct the ablating laser beam 116. The film 126 is replaced after a number of plate exposures.

Lead screws 120 with a motor (not shown) provide the laser beam scanning action in the slow scanning direction indicated by arrow 122. A lens 124 focuses the scanning beam. A thin transparent MYLAR film 126, with thickness of 25 to 50 microns, is placed between the plate and the pair of permanent rectangular block sintered ferrite magnets 128. The ablation debris attracted by the magnetic field forces precipitate on the MYLAR film 126. This arrangement protects the optics from becoming dirty. The MYLAR film 126 may be removed and replaced when it becomes soiled/dirty.

Figure 7:
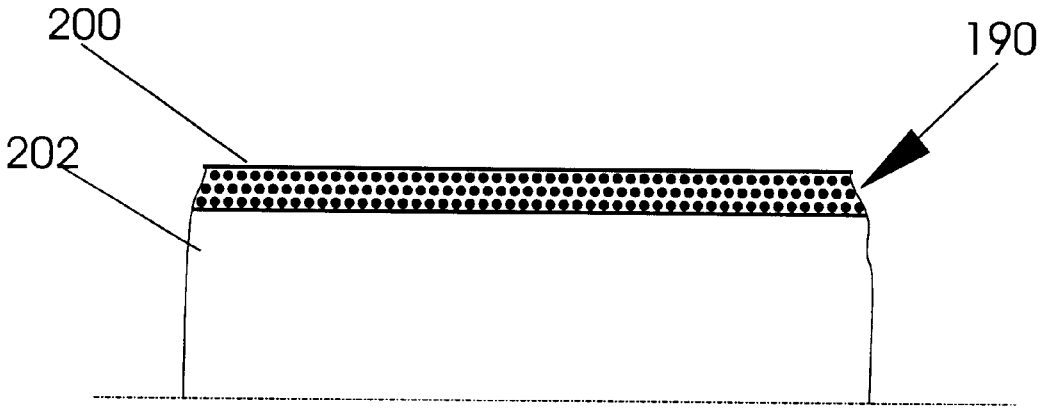
FIG. 7 is a schematic illustration of a basic structure of a direct imaging flexographic plate with a self-cleaning ablation coating, constructed in accordance with a preferred embodiment of the present invention.

FIG. 7 shows another preferred embodiment of the invention. FIG. 7 is a schematic illustration of a basic structure of a direct imaging flexographic plate, generally denoted by numeral 190, with a self-cleaning ablation coating, constructed in accordance with present invention. Here, the coating 200 is deposited over a flexographic plate 202. Current direct exposure flexographic plates have a very thin ablatable coating of about 1–3 micron. The coating has to be easily ablated and dark enough to avoid UV penetration, used at the next exposure step, into the protected material. These two contradictory requirements are difficult to meet by regular ablatable coatings. The coating of the invention, dispersed with magnetic particles, produces a thick enough layer (depending on the load of particles) to avoid UV penetration and is easily ablatable.

Since the ablatable coating is washed off after UV curing, simple wax coating dispersed with magnetic particles may be used in this case.

Figure 8:
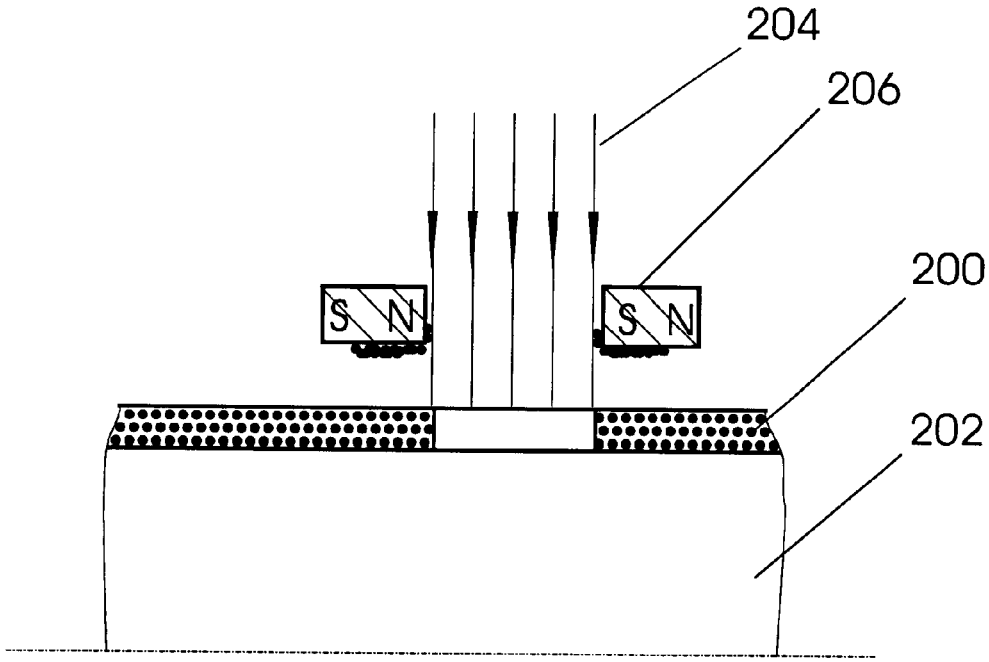
FIG. 8 is a schematic illustration of the ablation process with automatic debris collection, of the direct imaging flexographic plate with the self cleaning ablation coating of FIG. 7.

FIG. 8 is a schematic illustration of the ablation process with automatic debris collection of the direct imaging flexographic plate 190 with the self cleaning ablation coating, of FIG. 7. The ablation is performed by a laser beam 204, which in this particular case exposes through an arrangement of a set of permanent magnets 206, similar to the one described earlier. As in the previous case, both the removal of coating material and the protection of the optics are aided by the permanent magnets 206, that attract the magnetic particles of the coating 200 together with some coating material of the flexographic plate base 202. Electromagnetic elements may be used instead of the permanent magnets.

Figure 9:
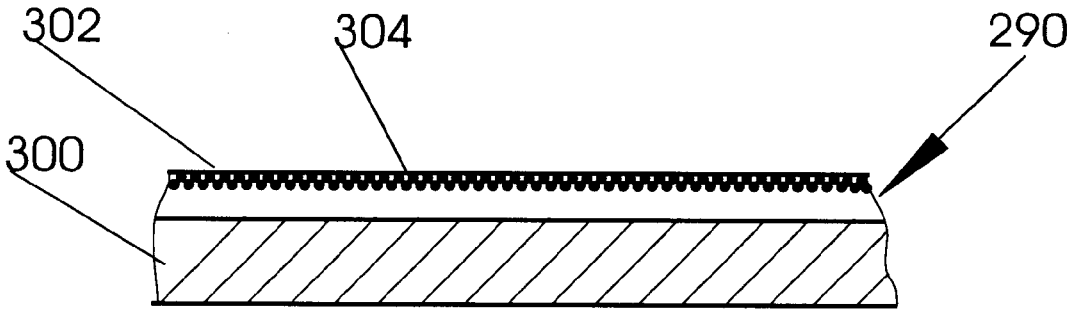
FIG. 9 is a schematic illustration of a basic structure of an erasable offset printing plate, according to a preferred embodiment of the invention.

Another preferred embodiment of the invention provides an erasable plate. FIG. 9 is a schematic illustration of a basic structure of an erasable offset printing plate, generally denoted by numeral 290, comprising a base material 300 and a coating 302. The emulsion coating is once again a polymer, dispersed with magnetic particles 304. The coating 302 preferably has a relatively low "Glass Transition Temperature" Tg (and may be, e.g., polystyrene). During the coating process, the magnetic particles 304 dispersed in the coating material are arranged to occupy a permanent and organized position at the top or bottom of the coating layer. This may be achieved by applying a permanent magnetic field when the coating is applied. The coating may be applied as a solution.

The organized layer of magnetite particles should be very close to the surface of the coating 302, and even slightly protrude through it. Magnetite is typically hydrophilic and in such orientation will create a hydrophilic surface. The coating 302 should be hydrophobic/oleophilic.

Figure 10:
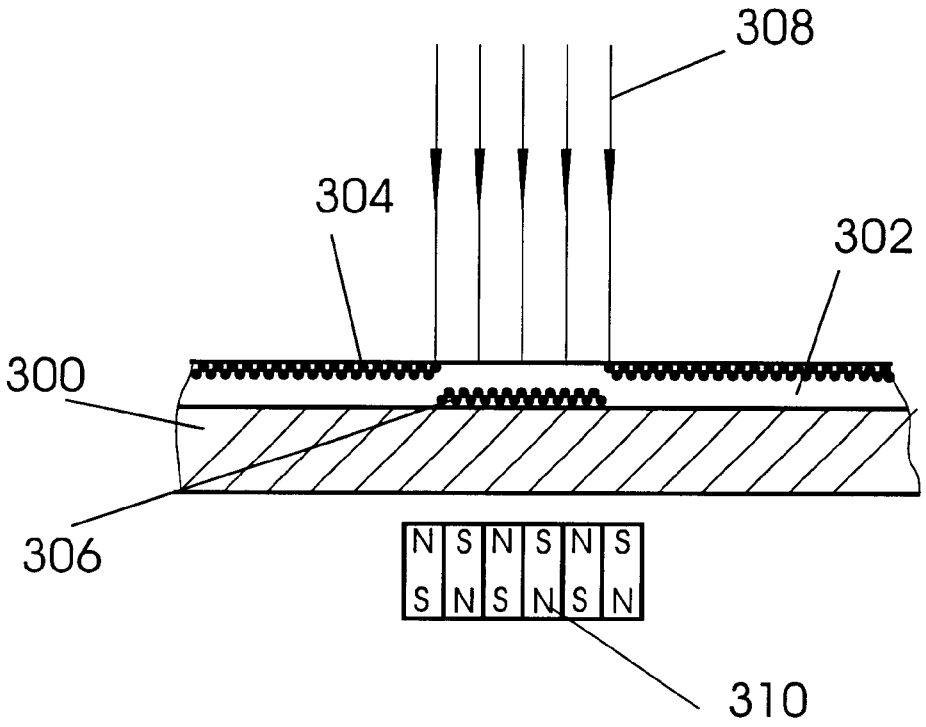
FIG. 10 is a schematic illustration of the exposure process of the erasable offset printing plate of FIG. 9.

FIG. 10 is simplified illustration of the exposure/imaging unit suitable for imaging the erasable offset printing plate 290 of FIG. 9. A laser beam performs the exposure. The beam 308 locally heats up the coating layer 302 to above its glass transition temperature, where the coating layer 302 becomes soft or even fluid. A multiple pole electro-magnet or a plurality of permanent magnets 310 that create a uniform magnetic field are placed beneath or above the base 300. This uniform magnetic field attracts/moves the magnetic particles 304, to new position 306, on the bottom/top of the coating layer 302, depending on the location of the magnets relative to the plate. The exposed area now contains only the coating 302, which is oleophilic/hydrophobic.

Figure 11:
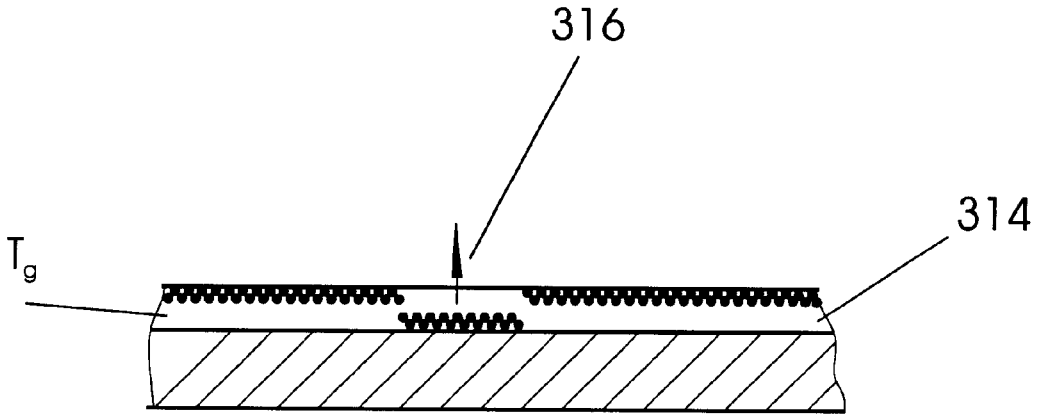
FIG. 11 is a schematic illustration of the process of erasure of the information from the erasable offset printing plate of FIG. 9.

Upon completion of the printing process, the plate is erased, as shown in FIG. 11. Here the whole plate/ coating layer 314 is heated to the glass transition temperature and placed under or over a uniform/even magnetic field. This magnetic field causes the magnetite particles to move to their initial or extreme position, as indicated by arrow 316.

Figure 12:
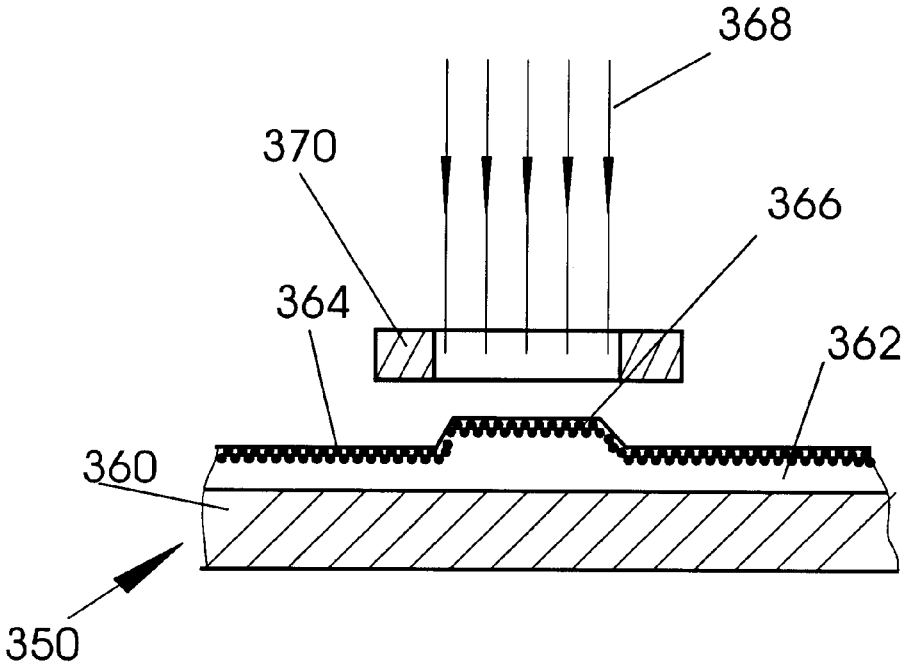
FIG. 12 shows a basic structure of an erasable relief printing plate and principles of an exposure apparatus adapted for this purpose, according to a preferred embodiment of the invention.

A further embodiment of the invention relates to another erasable plate. FIG. 12 shows the basic structure of an erasable relief printing plate and schematically illustrates the principles of an exposure apparatus adapted for this purpose. The erasable relief printing plate, generally denoted by numeral 350, comprises a base material 360 and an emulsion coating 362. The emulsion coating is once again a regular polymer dispersed with magnetic particles 364. The magnetic particles 364 may, but do not have to, be placed in an orderly position. The emulsion 362 preferably has a relatively low "Glass Transition Temperature" Tg (e.g., that of polystyrene).

A laser beam 368 performs the exposure. The beam locally heats up the layer 362 to its glass transition temperature, so that it becomes soft or even fluid. The magnetic field created by an electro-magnet or a permanent magnet 370, placed over/beneath the plate base 360, attracts/moves the magnetic particles 364 to their new position 366 on the bottom/top of the emulsion layer 364. The upward/downward moving particles pull or compress the material, depending on their direction, and create flexographic or gravure type plate structure. In case of upward particle movement, care should be taken not to expel magnetic particle off the coating and not to damage the coating while in its soft or even fluid state.

Figure 13:
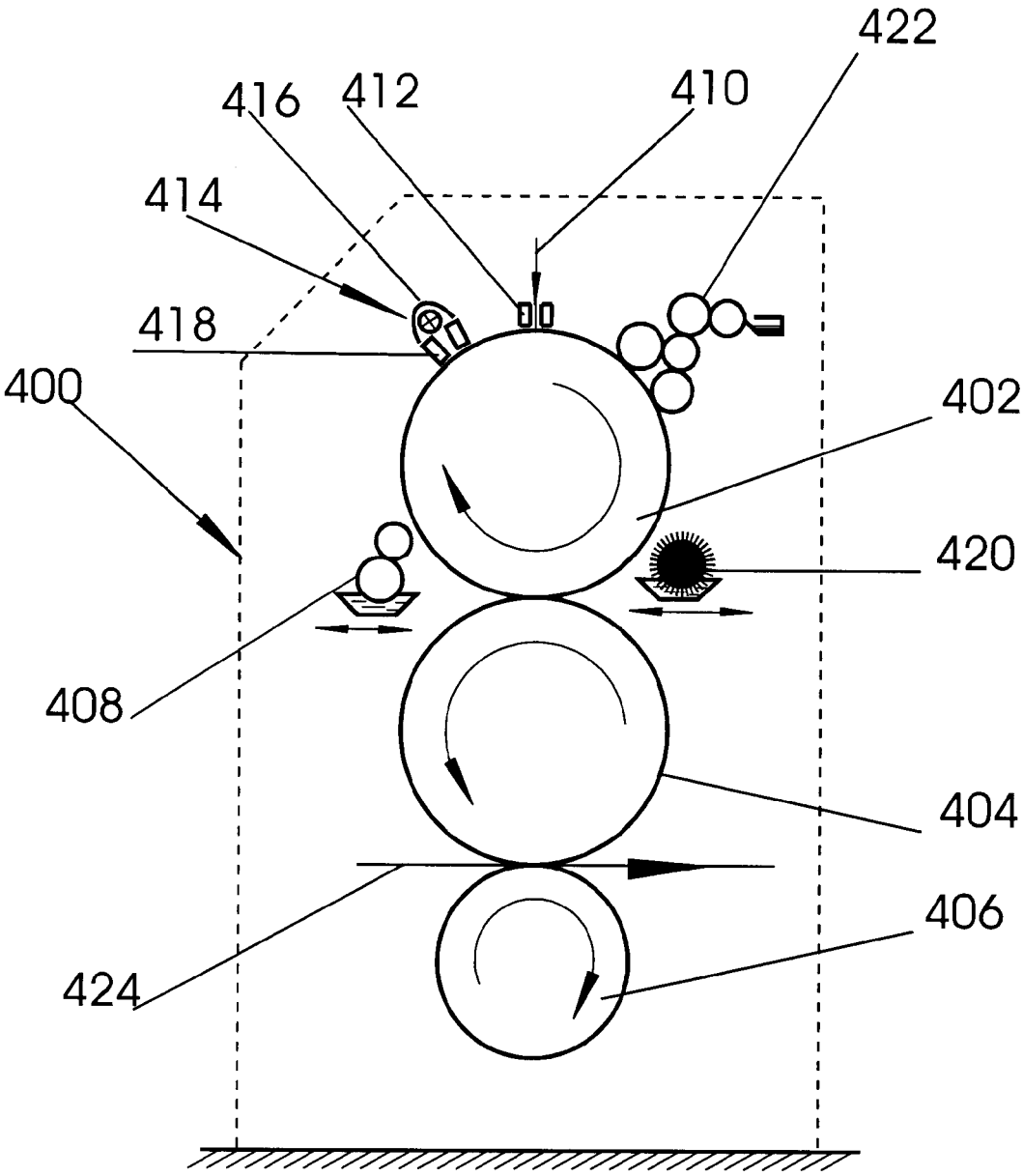
FIG. 13 schematically illustrates a press with printing cylinders coated with the erasable offset printing plate emulsion or with the erasable relief printing plate material according to preferred embodiments of the invention.

It is clear that the materials described with reference to FIGS. 9 and 12 may be coated on both flat and cylindrical surfaces. When coated on cylindrical surfaces, they are mounted on a press to be used in an on-press imaging system. FIG. 13 is a schematic illustration of a press with printing cylinders, coated with the erasable offset printing plate coating of FIG. 9, or with the erasable relief printing plate material of FIG. 12. The press 400 consists of a plate cylinder 402, blanket cylinder 404, and impression cylinder 406. The plate cylinder 402 is coated by a coating similar to the one described with reference to FIGS. 9 and 12. The cylinder 402 may be pre-coated and removable, or alternatively the press 400 may be equipped with a coating device 408. The coating device 408 has working and idle positions. A laser beam 410 performs the exposure. The beam 410 locally heats up the coating layer on the cylinder to above its glass transition temperature, where the emulsion layer becomes soft or even fluid. A multiple pole electromagnet or a plurality of permanent magnets 412 that create a uniform magnetic field are placed above the plate cylinder 402. This uniform magnetic field causes the magnetic particles to move to their new position, on the bottom or on the top of the coating layer, depending on the polarity of the magnetic field. The exposed area now contains only the coating, which is oleophilic/hydrophobic. The printing is performed like on a regular press. Numerals 422 and 424 respectively indicate the inking system and the paper.

Upon completion of the printing process, the plate is erased by a plate-erasing device 414 consisting of a heat source 416, such as an IR lamp and an arrangement of permanent or electric magnets 418. The heat source 416 heats up the whole coating layer to the glass transition temperature. The arrangement of permanent or electric magnets 418 creates a uniform magnetic field. This magnetic field causes the magnetite particles to move to their initial position that was existing before the imaging, or to the farmost position physically possible. The process may be repeated many times. When the coating layer has to be renewed, the old layer may be removed by a cleaning device 420 and the cylinder recoated by the coating device 408.

All image erasure processes have been described earlier. It might be added that in some cases, depending on the magnetite particles size and load, it might be possible to erase/record the information just by using the centrifugal force.

While embodiments of the invention have been described by way of illustration, it will be understood that the invention can be carried out by persons skilled in the art with many modifications, variations and adaptations, without departing from its spirit or exceeding the scope of the claims.

What is claimed is:

1. A process for manufacturing a printing member, comprising providing in an ablatable lithographic printing plate or an ablatable masking film one or more layers containing magnetic particles, and imaging the plate or film in a magnetic field, said magnetic field being of magnitude and direction suitable to collect the magnetic particles and associated ablated materials from the image areas of said printing plate or said film, thereby to eliminate debris and the need for other plate processes.

2. A process according to claim 1 further comprising providing an optically transparent film, positioned between the ablated plate or ablated masking film and ablating optics, whereby the debris is collected by said optically transparent film.

3. A process according to claim 2, wherein said optically transparent film is provided in a slidable form that can be continuously replaced during said process.

* * * * *